US009500016B2

(12) United States Patent
Wang et al.

(10) Patent No.: US 9,500,016 B2
(45) Date of Patent: Nov. 22, 2016

(54) POSITION ADJUSTING MECHANISM OF A SOFT-CLOSING DEVICE FOR A SLIDING DOOR

(71) Applicant: Weider Metal Inc., New Taipei (TW)

(72) Inventors: Grace Show-Yin Wang, New Taipei (TW); Jacquelin Wu, New Taipei (TW); Jennifer Wu, New Taipei (TW); Andy Wu, New Taipei (TW)

(73) Assignee: Weider Metal Inc., New Taipei (TW)

( * ) Notice: Subject to any disclaimer, the term of this patent is extended or adjusted under 35 U.S.C. 154(b) by 93 days.

(21) Appl. No.: 14/559,318

(22) Filed: Dec. 3, 2014

(65) Prior Publication Data

US 2016/0040465 A1 Feb. 11, 2016

(30) Foreign Application Priority Data

Aug. 5, 2014 (TW) ..... 103213909 U

(51) Int. Cl.
*E05F 1/16* (2006.01)
*E05F 5/00* (2006.01)

(52) U.S. Cl.
CPC ..... *E05F 1/16* (2013.01); *E05F 5/003* (2013.01); *Y10T 16/27* (2015.01); *Y10T 16/376* (2015.01); *Y10T 16/379* (2015.01)

(58) Field of Classification Search
CPC ..... E05F 1/16; E05F 3/227; E05F 5/003; E05D 11/0009; Y10T 16/27; Y10T 16/35; Y10T 16/376; Y10T 16/379
See application file for complete search history.

(56) References Cited

U.S. PATENT DOCUMENTS 549,589 A * 11/1895 Shrawder ..... E05F 3/104 16/49
556,572 A * 3/1896 Bataille ..... E05B 85/22 16/87 R
6,438,795 B1 * 8/2002 Haab ..... E05D 13/04 16/85
6,487,752 B1 * 12/2002 Mathews ..... E05F 5/003 16/86 A
6,578,320 B1 * 6/2003 Munton ..... E05F 1/16 49/363
8,272,166 B2 * 9/2012 Nezu ..... E05B 65/0858 49/358
8,307,497 B2 * 11/2012 Chang ..... E05F 5/003 16/49
8,402,606 B1 * 3/2013 Tsai ..... E05F 3/18 16/49
8,418,406 B2 * 4/2013 Zimmer ..... E05F 1/16 16/49
8,726,574 B2 * 5/2014 Iwaki ..... E05F 1/16 16/49
8,827,388 B2 * 9/2014 Johansson ..... A47B 88/0481 312/333
8,931,138 B2 * 1/2015 Shimizu ..... A47B 88/047 16/49
9,004,429 B2 * 4/2015 Dennison ..... A47H 1/04 16/94 D
2007/0283524 A1 * 12/2007 Gordon ..... E05F 1/16 16/78

* cited by examiner

*Primary Examiner* — Jeffrey O Brien
(74) *Attorney, Agent, or Firm* — C. G. Mersereau; Nikolai & Mersereau, P.A.

(57) ABSTRACT

A position adjusting mechanism of a soft-closing device for a sliding door has a bracket with a mounting panel and at least one positioning rack, a cover panel mounted on the bracket, and a positioning hook, a torsion spring and a driving element pivotally mounted on the cover panel. At least one first fastener is mounted through the cover panel and the mounting panel and is fastened to a door track. The bracket can slide relative to the cover panel to allow the positioning hook to selectively engage in different engaging recesses of a corresponding positioning rack. Thus, moving distance of the bracket and a door panel suspended from the bracket can be estimated. Accordingly, positions of the bracket and the door panel on the door track can be adjusted to allow the door panel to close a doorway completely.

20 Claims, 7 Drawing Sheets

POSITION ADJUSTING MECHANISM OF A SOFT-CLOSING DEVICE FOR A SLIDING DOOR

BACKGROUND OF THE INVENTION

1. Field of the Invention

The present invention relates to a position adjusting mechanism of a soft-closing device for a sliding door, especially to a position adjusting mechanism that facilitates position adjustment of the soft-closing device and a door panel held by the soft-closing device when the door panel is closed.

2. Description of the Prior Art(s)

A sliding door is a type of door commonly mounted in a doorway of a building, and comprises a door panel that can transversely slide in a door track so as to selectively open or close the doorway. A conventional sliding door further comprises a bracket mounted on the door track and a soft-closing device mounted on the bracket. When a user pushes or pulls the door panel to open or close the doorway and the door panel slides along the door track until the door panel is connected to the soft-closing device, the soft-closing device cushions excessive pushing or pulling force applied to the door panel with a pneumatic cylinder or a hydraulic cylinder, and pulls the door panel to continue sliding to open or close the doorway with a spring. Thus, a sliding speed of the door panel can be decelerated to prevent the door panel from hitting a door frame abruptly and making loud noises, and to prevent children and the elder from being jammed by the door panel.

However, in the conventional sliding door, the bracket is directly attached to the door track via multiple fasteners. Therefore, once the door track is embedded in the building, a closed position of the door panel for closing the doorway and an open position of the door panel for opening the doorway are determined. Take closing the doorway as an example. When the door panel is pulled by the soft-closing device to the closed position and the user finds that a gap exists between the door panel and the door frame, it is hard to further adjust positions of the bracket and the soft-closing device on the door track.

In order to eliminate the gap between the door panel and the door frame when the door panel is closed, additional holes are drilled on the door track or the bracket for mounting the fasteners in order to reposition the bracket and the door panel. Nevertheless, the drilled holes of the door track or the bracket may partially overlap and be enlarged. Thus, the bracket and the door panel are unable to be stably mounted on the door track. Moreover, the gap may still exist after the bracket and the door panel have been repositioned, causing the door panel unable to close the doorway completely. Therefore, it is inconvenient and troublesome to mount a sliding door in the doorway of the building.

To overcome the shortcomings, the present invention provides a position adjusting mechanism of a soft-closing device for a sliding door to mitigate or obviate the aforementioned problems.

SUMMARY OF THE INVENTION

The main objective of the present invention is to provide a position adjusting mechanism of a soft-closing device for a sliding door. The position adjusting mechanism has a bracket with a mounting panel and at least one positioning rack, a cover panel mounted on the bracket, and a positioning hook, a torsion spring and a driving element pivotally mounted on the cover panel. Each of the at least one positioning rack has multiple engaging recesses. At least one first fastener is mounted through the cover panel and the mounting panel and is fastened to a door track.

The bracket can slide relative to the cover panel to allow the positioning hook to selectively engage in one of the different engaging recesses of a corresponding one of the at least one positioning rack. Thus, moving distance of the bracket and a door panel suspended from the bracket can be estimated. Accordingly, positions of the bracket and the door panel on the door track can be adjusted to allow the door panel to close a doorway completely.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
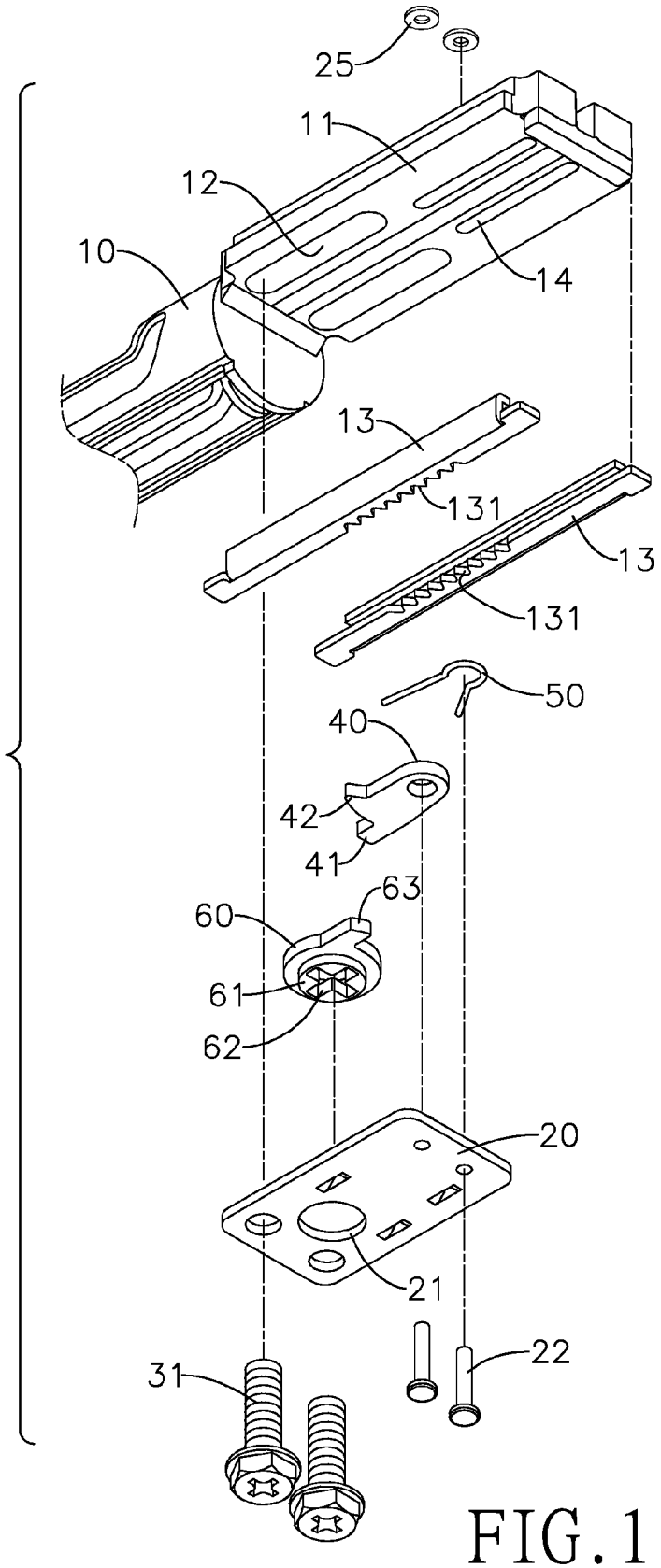
FIG. 1 is an exploded perspective view of a position adjusting mechanism of a soft-closing device for a sliding door in accordance with the present invention.

With reference to FIG. 1, a position adjusting mechanism of a soft closing device for a sliding door comprises a bracket 10, a cover panel 20, a positioning hook 40, a torsion spring 50, a driving element 60, at least one sliding rod 22, at least one first fastener 31, and at least one second fastener 32.

Figure 2:
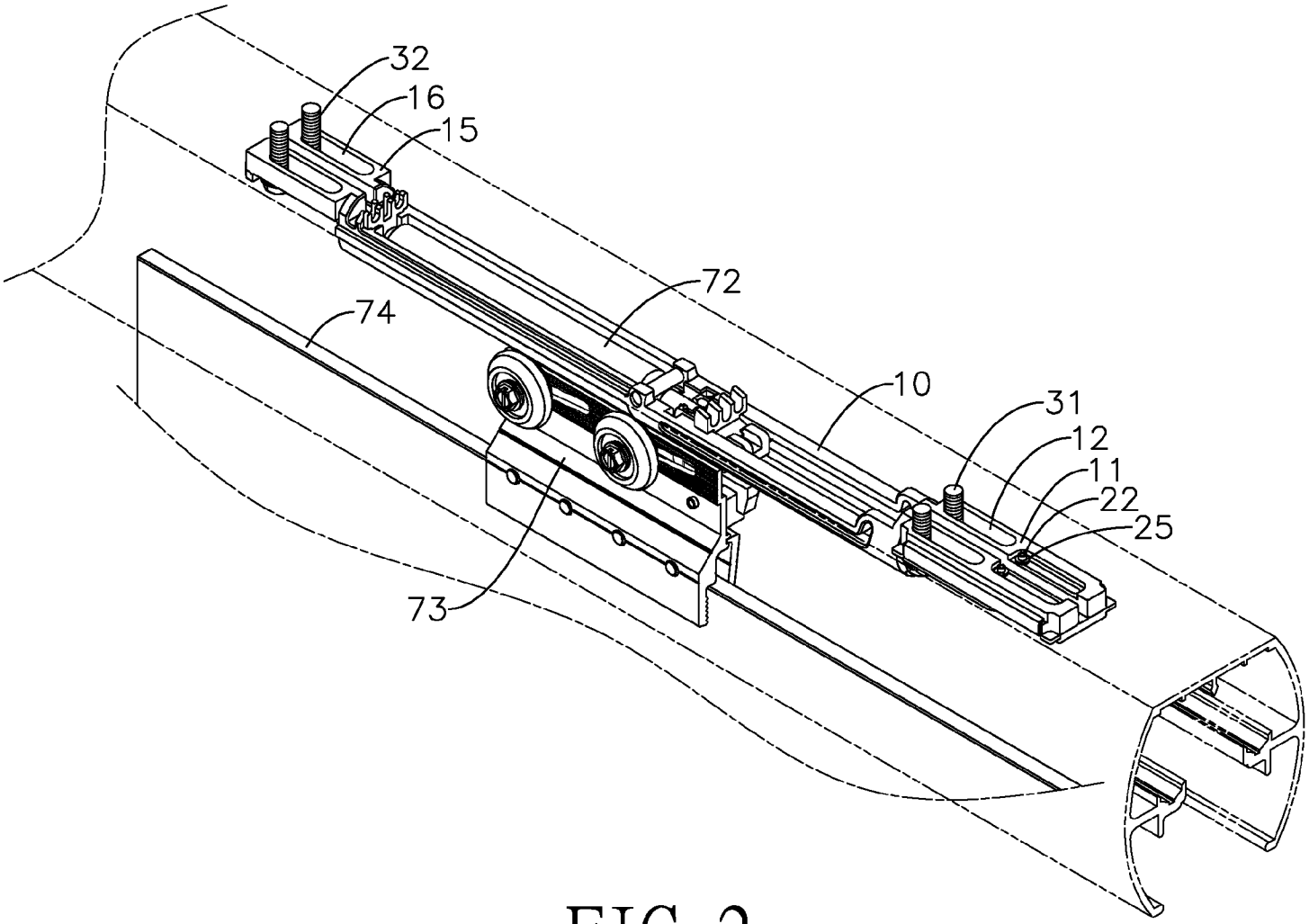
FIG. 2 is an operational perspective view of the position adjusting mechanism in FIG. 1.

With further reference to FIG. 2, the bracket 10 is elongated and is mounted in a door track 71 of the sliding door. The bracket 10 has two opposite ends, a mounting panel 11, and a supporting panel 15.

The mounting panel 11 is formed on one of the ends of the bracket 10 and has a lower surface, two side edges, at least one adjusting hole 12, at least one sliding hole 14, and at least one positioning rack 13. The side edges of the mounting panel 11 are disposed opposite to each other and are parallel to a long axis of the bracket 10.

The at least one adjusting hole 12 of the mounting panel 11 is formed through the mounting panel 11. Each of the at least one adjusting hole 12 of the mounting panel 11 is elongated and extends parallel to the side edges of the mounting panel 11, i.e. extends parallel to the long axis of the bracket 10. The at least one sliding hole 14 is formed through the mounting panel 11. Each of the at least one sliding hole 14 is elongated and extends parallel to the side edges of the mounting panel 11, i.e. extends parallel to the long axis of the bracket 10.

The at least one positioning rack 13 is disposed on the lower surface of the mounting panel 11. Each of the at least one positioning rack 13 is toothed, is disposed along a corresponding one of the side edges of the mounting panel 11, and has multiple engaging recesses 131. The engaging recesses 131 are linearly arranged.

The supporting panel 15 is formed on the other end of the bracket 10 and has at least one adjusting hole 16. The at least one adjusting hole 16 of the supporting panel 15 is formed through the supporting panel 15. Each of the at least one adjusting hole 16 of the supporting panel 15 is elongated and extends parallel to the at least one adjusting hole 12 of the mounting panel 11, i.e. extends parallel to the long axis of the bracket 10.

In the preferred embodiment, the mounting panel 11 of the bracket 10 has two positioning racks 13. The positioning racks 13 and the mounting panel 11 are separate parts. The positioning racks 13 are detachably mounted on the lower surface of the mounting panel 11 and are respectively disposed along the side edges of the mounting panel 11. Alternatively, the positioning racks 13 and the mounting panel 11 may be integrally formed as a single part.

The cover panel 20 is mounted below the mounting panel 11 and has an inner surface and a through hole 21. The inner surface of the cover panel 20 faces the lower surface of the mounting panel 11. The through hole 21 is formed through the cover panel 20.

Figure 3:
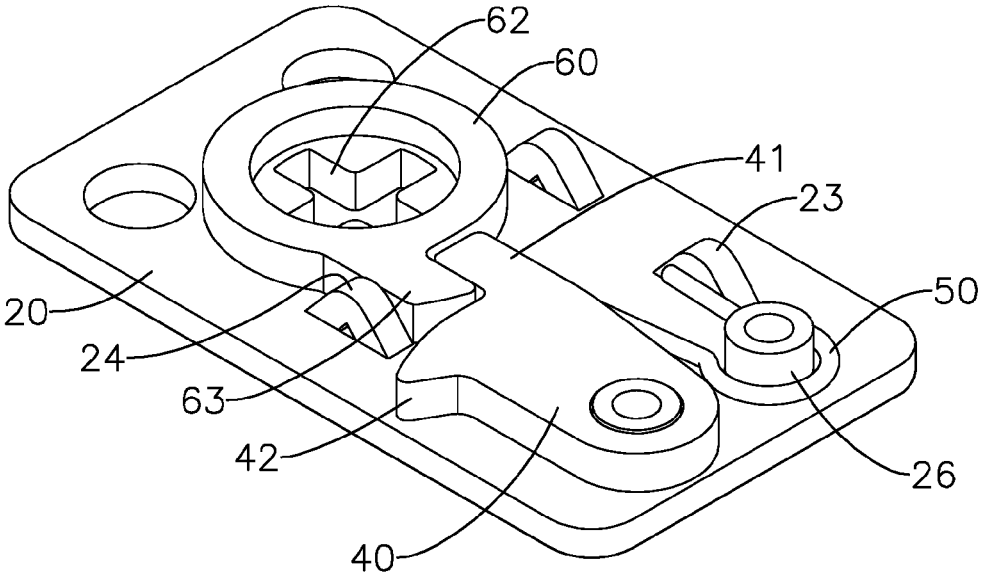
FIG. 3 is an enlarged partial perspective view of the position adjusting mechanism in FIG. 1.

With further reference to FIG. 3, the positioning hook 40 is pivotally mounted on the inner surface of the cover panel 20 and has a side edge, a driven protrusion 41, and an engaging protrusion 42. The driven protrusion 41 protrudes from the side edge of the positioning hook 40. The engaging protrusion 42 protrudes from the side edge of the positioning hook 40 and toward a corresponding one of the at least one positioning rack 13, and selectively engages in one of the engaging recesses 131 of the corresponding positioning rack 13.

The torsion spring 50 is mounted on the inner surface of the cover panel 20 and has two ends. One of the ends of the torsion spring 50 is stationary. The other end of the torsion spring 50 abuts the positioning hook 40 and pushes the positioning hook 40 to rotate, such that the engaging protrusion 42 of the positioning hook 40 engages in one of the engaging recesses 131 of the corresponding positioning rack 13.

The driving element 60 is pivotally mounted on the inner surface of the cover panel 20, is disposed beside the driven protrusion 41 of the positioning hook 40, and corresponds in position to the through hole 21 of the cover panel 20. The driving element 60 has a side edge, a boss 61, a driving recess 62, and a driving protrusion 63. The boss 61 is formed on a bottom of the driving element 60 and rotatably protrudes in the through hole 21 of the cover panel 20, such that the driving element 60 can rotate on the boss 61. The driving recess 62 is formed in the boss 61, and may be a slot or cruciform, rectangular, hexagonal, star-shaped, or the like in cross-section. Thus, the driving element 60 can be driven to rotate by a screw driver that has a tip corresponding in shape to the driving recess 62 of the driving element 60. In the preferred embodiment, the driving recess 62 is cruciform. The driving protrusion 63 protrudes from the side edge of the driving element 60 and abuts against the driven protrusion 41 of the positioning hook 40.

In the preferred embodiment, the cover panel 20 further has a first stop protrusion 23 and a second stop protrusion 24. The first stop protrusion 23 and the second stop protrusion 24 are separately formed on the inner surface of the cover panel 20. The torsion spring 50 is disposed between the positioning hook 40 and the first stop protrusion 23. The two ends of the torsion spring 50 respectively and resiliently abut against the first stop protrusion 23 and the positioning hook 40, so as to push the positioning hook 40 to rotate. Accordingly, the engaging protrusion 42 stably engages in one of the engaging recesses 131 of the corresponding positioning rack 13. The driving protrusion 63 of the driving element 60 is disposed between the second stop protrusion 24 and the driven protrusion 41 of the positioning hook 40. The driven protrusion 41 of the positioning hook 40 pushes the driving protrusion 63 of the driving element 60 to abut against the second stop protrusion 24 of the cover panel 20, such that a rotation range of the driving element 60 can be limited.

The at least one sliding rod 22 is securely attached to the cover panel 20. Each of the at least one sliding rod 22 is mounted through the at least one sliding hole 14 of the mounting panel 11 and is connected with a washer 25. Thus, the cover panel 20 is mounted on the mounting panel 11 of the bracket 10, and the bracket 10 can slide relative to the cover panel 20, the positioning hook 40, the torsion spring 50, the driving element 60, and the at least one sliding rod 22 along the long axis of the bracket 10.

Figure 4:
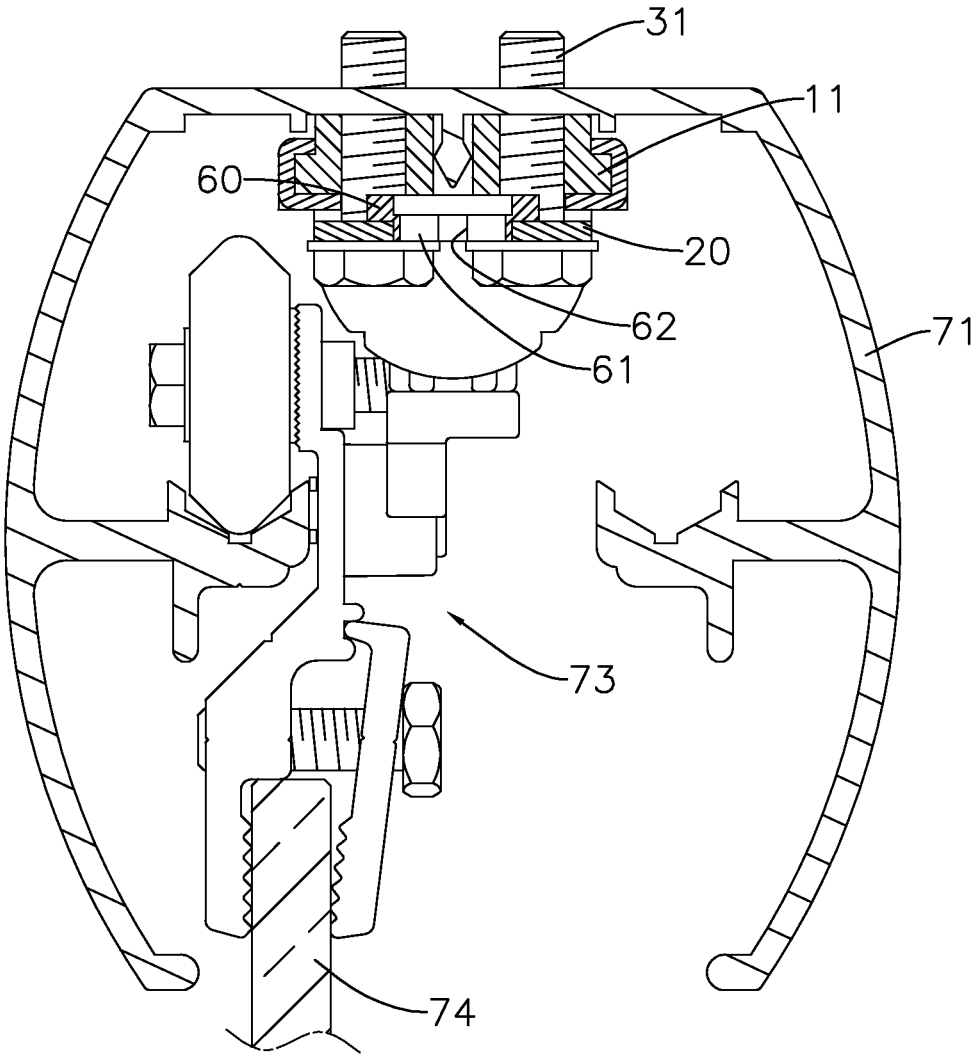
FIG. 4 is an operational side view in partial section of the position adjusting mechanism in FIG. 1.

With further reference to FIG. 4, the at least one first fastener 31 is mounted through the cover panel 20 and the at least one adjusting hole 12 of the mounting panel 11 of the bracket 10. The at least one second fastener 32 is mounted through the at least one adjusting hole 16 of the supporting panel 15 of the bracket 10. Moreover, the at least one first fastener 31 and the at least one second fastener 32 can be further fastened to the door track 71. Thus, the bracket 10 is mounted on the door track 71 and a relative position of the cover panel 20 and the door track 71 is fixed.

When the driving element 60 is driven to rotate, the driving element 60 further drives the positioning hook 40 to rotate via the driving protrusion 63 and the driven protrusion 41. The driving element 60 and the torsion spring 50 push the positioning hook 40 to rotate toward reverse directions. The torsion spring 50 pushes the positioning hook 40 to allow the engaging protrusion 42 of the positioning hook 40 to stably engage in one of the engaging recesses 131 of the corresponding positioning rack 13. The driving element 60 drives the positioning hook 40 to allow the engaging protrusion 42 of the positioning hook 40 to disengage from the engaging recess 131 of the corresponding positioning rack 13.

In the preferred embodiment, the at least one sliding hole 14 comprises two sliding holes 14. The cover panel 20 further has two mounting protrusions 26. The mounting protrusions 26 are tubular, are separately formed on the inner surface of the cover panel 20, and respectively correspond in position to the two sliding holes 14 of the mounting panel 11. The positioning hook 40 is mounted around one of the mounting protrusions 26. The torsion spring 50 is mounted around the other mounting protrusion 26. The at least one sliding rod 22 comprises two sliding rods 22. The sliding rods 22 are respectively mounted through the mounting protrusions 26, are respectively mounted through the sliding holes 14 of the mounting panel 11, and then are respectively connected with the washers 25. The engaging protrusion 42 of the positioning hook 40 is a ratchet tooth.

Thus, when the torsion spring 50 pushes the positioning hook 40 to allow the engaging protrusion 42 to engage in one of the engaging recesses 131, the bracket 10 can slide forwardly relative to the positioning hook 40 and the cover panel 20 toward a first direction and cannot slide reversely toward a second direction. Only when the driving element 60 drives the positioning hook 40 to rotate to allow the engaging protrusion 42 to disengage from the engaging recess 131 can the bracket 10 slide reversely toward the second direction.

Figure 7:
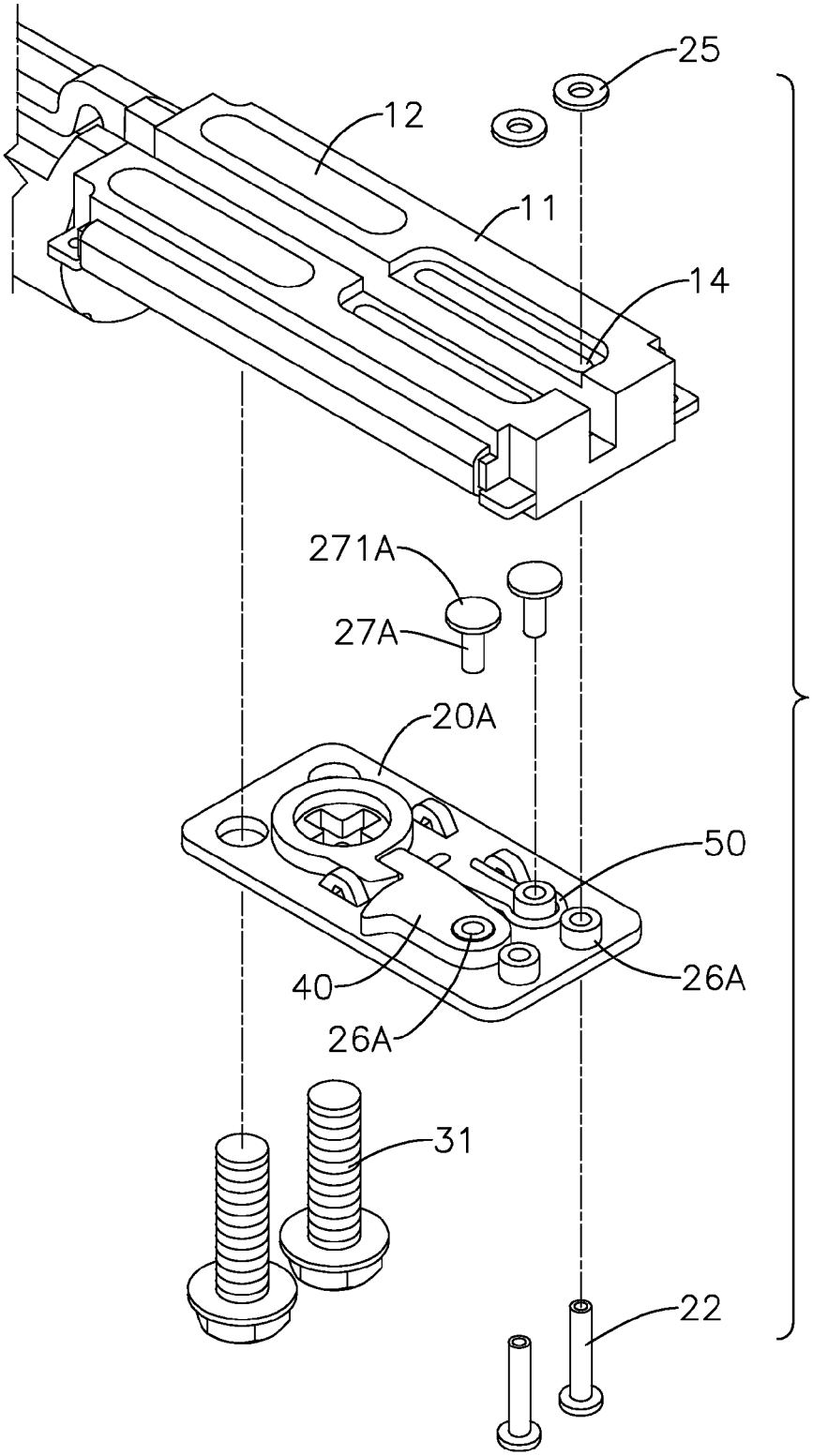
FIG. 7 is an exploded perspective view of another embodiment of a position adjusting mechanism of a soft-closing device for a sliding door in accordance with the present invention.

With further reference to FIG. 7, in another preferred embodiment, the cover panel 20A has four mounting protrusions 26A being tubular and separately formed on the inner surface of the cover panel 20A. The positioning hook 40 and the torsion spring 50 are respectively mounted around two of the mounting protrusions 26A. The sliding rods 22 are respectively mounted through the other two of the mounting protrusions 26A, are respectively mounted through the two sliding holes 14 of the mounting panel 11, and then are respectively connected with the washers 25.

Two riveting elements 27A are mounted through the two mounting protrusions 26A that the positioning hook 40 and the torsion spring 50 are mounted around, and are riveted to the cover panel 20A. Each of the riveting elements 27A has a head 271A abutting a distal end of a corresponding one of the mounting protrusions 26A. A diameter of the head 271A of each riveting element 27A is larger than a diameter of the corresponding mounting protrusion 26A. Thus, the positioning hook 40 and the torsion spring 50 can be held between the cover panel 20A and the heads 271A of the riveting elements 27A and do not come off from the cover panel 20A.

As shown in FIG. 2, a soft-closing device 72 is mounted in the bracket 10, a hanger 73 is slidably mounted in the door track 71, and a door panel 74 is held by the hanger 73, such that the door panel 74 slides along with the hanger 73. When the hanger 73 and the door panel 74 slide along the door track 71 toward the soft-closing device 72, the hanger 73 connects with the soft-closing device 72 and the soft-closing device 72 decelerates sliding of the hanger 73 and the door panel 74.

Figure 5:
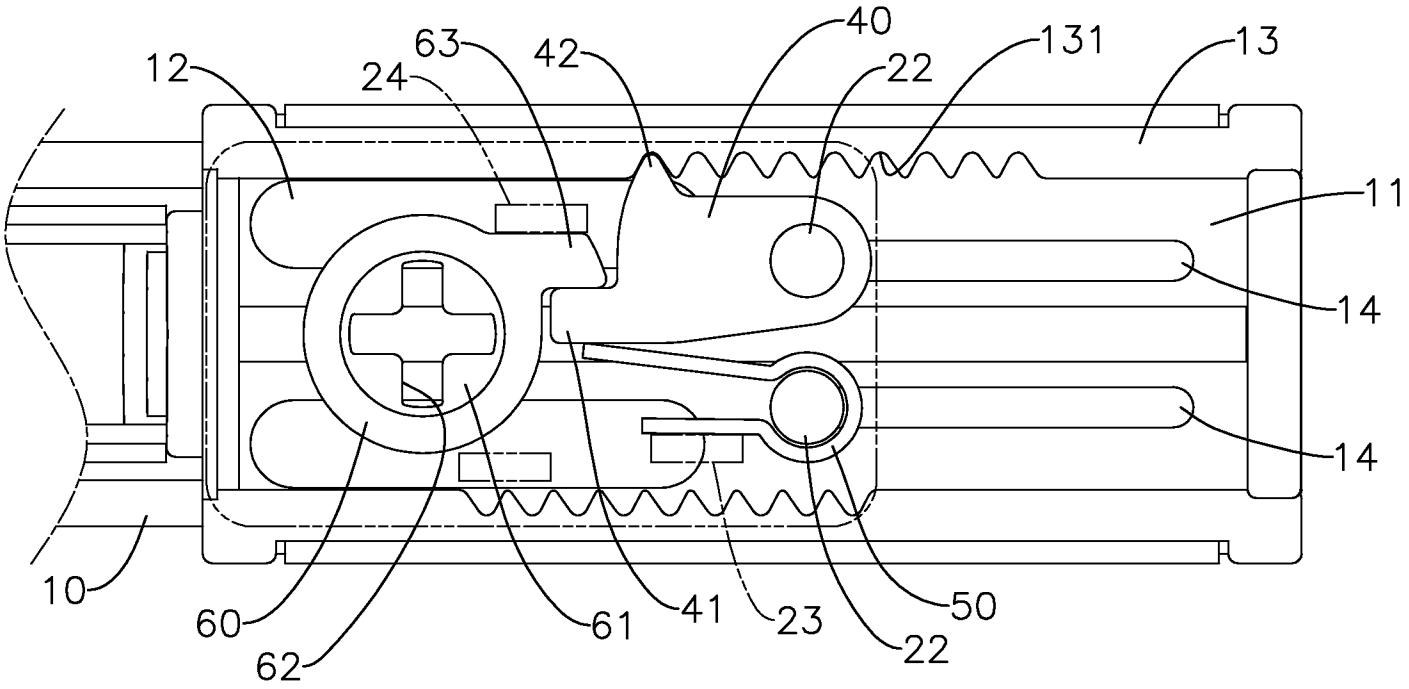
FIG. 5 is a bottom view of the position adjusting mechanism in FIG. 1, showing a cover panel in phantom line.

With further reference to FIG. 5, when adjusting a position of the bracket 10 on the door track 71, the first and second fasteners 31, 32 should be slightly loosened to reduce a holding force applied by the first and second fasteners 31, 32 and on the cover panel 20 and the mounting panel 11 and the supporting panel 15 of the bracket 10. Then, as the engaging protrusion 42 of the positioning hook 40 is the ratchet tooth, the bracket 10 can be directly moved toward the first direction. Meanwhile, the engaging protrusion 42 of the positioning hook 40 passes and engages in the engaging recesses 131 of the corresponding positioning rack 13 stepwise until the bracket 10 is moved to a desired position. Since the engaging recesses 131 are spaced by a specific distance, moving distance of the bracket 10 can be estimated accordingly.

Figure 6:
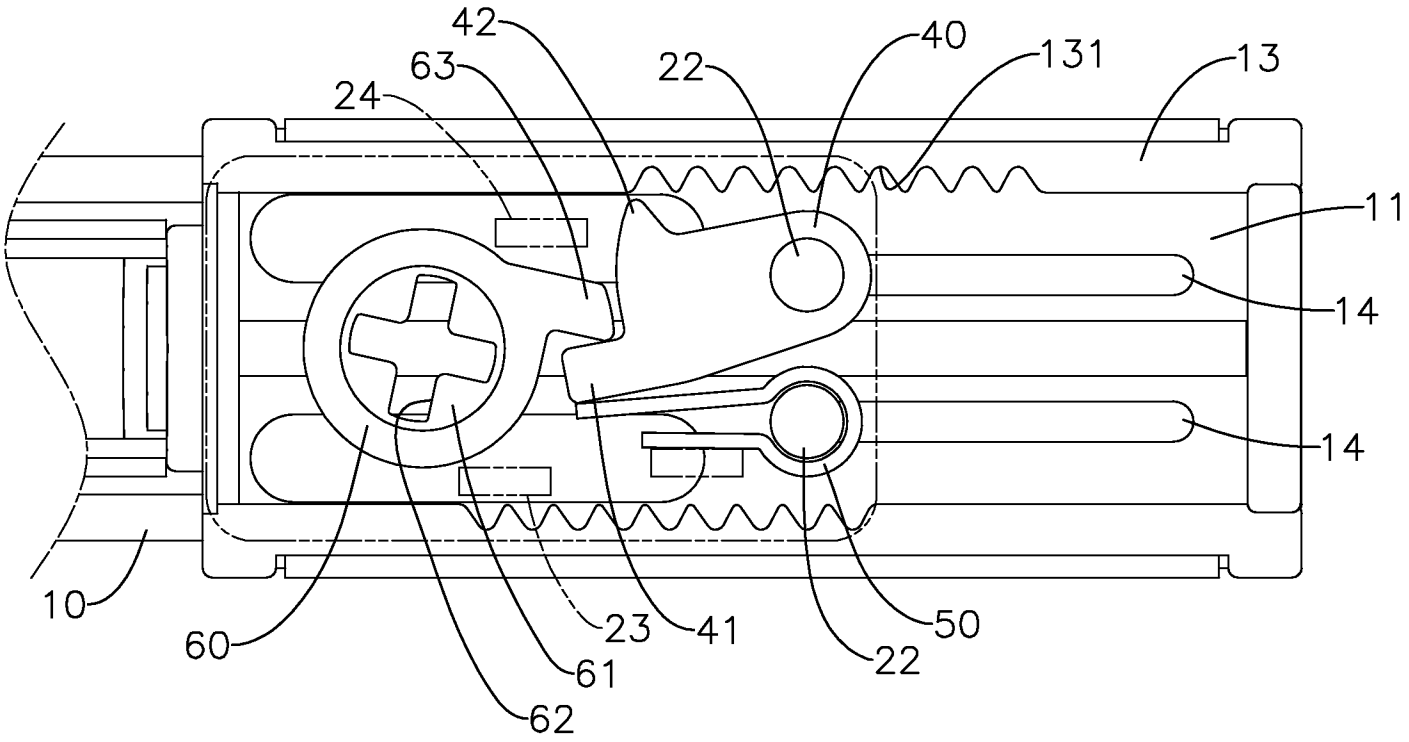
FIG. 6 is an operational bottom view of the position adjusting mechanism in FIG. 1, showing the cover panel in phantom line.

With further reference to FIG. 6, if the bracket 10 has to be moved toward the second direction, the driving element 60 is driven to drive the positioning hook 40 to rotate and to elastically deform the torsion spring 50. Thus, the engaging protrusion 42 of the positioning hook 40 disengages from the engaging recess 131 of the positioning rack 13 and the bracket 10 can be moved toward the second direction. Accordingly, the position of the bracket 10 on the door track 71 can be adjusted. When the bracket 10 is moved to the desired position and the driving element 60 is released, the torsion spring 50 pushes the positioning hook 40 to rotate reversely. Thus, the engaging protrusion 42 of the positioning hook 40 engages in the other engaging recess 131 of the corresponding positioning rack 13, and the driven protrusion 41 of the positioning hook 40 pushes the driving element 60 to rotate reversely via the driving protrusion 63 of the driving element 60.

Moreover, with the torsion spring 50 resiliently abutting the positioning hook 40, impact force exerted on the soft-closing device 72 when the hanger 73 and the door panel 74 bump into and are connected with the soft-closing device 72 can be buffered. Accordingly, the first and second fasteners 31, 32 would not slide or be loosened.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A position adjusting mechanism of a soft-closing device for a sliding door comprising:

a bracket having two opposite ends and a mounting panel, the mounting panel formed on one of the ends of the bracket and having a lower surface;

two opposite side edges;

at least one adjusting hole formed through the mounting panel, each of the at least one adjusting hole of the mounting panel being elongated and extending parallel to the side edges of the mounting panel;

at least one sliding hole formed through the mounting panel, each of the at least one sliding hole being elongated and extending parallel to the side edges of the mounting panel; and at least one positioning rack disposed on the lower surface of the mounting panel, each of the at least one positioning rack being toothed, disposed along a corresponding one of the side edges of the mounting panel and having multiple engaging recesses;

a cover panel mounted below the mounting panel and having an inner surface facing the lower surface of the mounting panel; and a through hole formed through the cover panel;

a positioning hook pivotally mounted on the inner surface of the cover panel and having a driven protrusion protruding from a side edge of the positioning hook; and an engaging protrusion protruding from the side edge of the positioning hook and toward a corresponding one of the at least one positioning rack, and selectively engaging in one of the engaging recesses of the corresponding positioning rack;

a torsion spring mounted on the inner surface of the cover panel and having two ends, one of the ends of the torsion spring being stationary, the other end of the torsion spring abutting the positioning hook and pushing the positioning hook to rotate, such that the engaging protrusion of the positioning hook engages in one of the engaging recesses of the corresponding positioning rack;

a driving element pivotally mounted on the inner surface of the cover panel, disposed beside the driven protrusion of the positioning hook, and corresponding in position to the through hole of the cover panel, the driving element having a driving protrusion protruding from a side edge of the driving element and abutting against the driven protrusion of the positioning hook, the driving element configured to selectively disengage the engaging protrusion from the engaging recess;

at least one sliding rod securely attached to the cover panel, each of the at least one sliding rod mounted through the at least one sliding hole of the mounting panel and connected with a washer; and at least one first fastener mounted through the cover panel and the at least one adjusting hole of the mounting panel of the bracket for non-slidably attaching the cover panel to a track.

2. The position adjusting mechanism as claimed in claim 1, wherein the bracket further has a supporting panel formed on the other end of the bracket and having at least one adjusting hole formed through the supporting panel, each of the at least one adjusting hole of the supporting panel being elongated and extending parallel to the at least one adjusting hole of the mounting panel; and the position adjusting mechanism further has at least one second fastener mounted through the at least one adjusting hole of the supporting panel of the bracket.

3. The position adjusting mechanism as claimed in claim 1, wherein the engaging protrusion of the positioning hook is a ratchet tooth.

4. The position adjusting mechanism as claimed in claim 2, wherein the engaging protrusion of the positioning hook is a ratchet tooth.

5. The position adjusting mechanism as claimed in claim 1, wherein the cover panel further has a first stop protrusion and a second stop protrusion, the first stop protrusion and the second stop protrusion separately formed on the inner surface of the cover panel;

the torsion spring is disposed between the positioning hook and the first stop protrusion;

the two ends of the torsion spring respectively and resiliently abut against the first stop protrusion and the positioning hook;

the driving protrusion of the driving element is disposed between the second stop protrusion and the driven protrusion of the positioning hook; and the driven protrusion of the positioning hook pushes the driving protrusion of the driving element to abut against the second stop protrusion of the cover panel.

6. The position adjusting mechanism as claimed in claim 2, wherein the cover panel further has a first stop protrusion and a second stop protrusion, the first stop protrusion and the second stop protrusion separately formed on the inner surface of the cover panel;

the torsion spring is disposed between the positioning hook and the first stop protrusion;

the two ends of the torsion spring respectively and resiliently abut against the first stop protrusion and the positioning hook;

the driving protrusion of the driving element is disposed between the second stop protrusion and the driven protrusion of the positioning hook; and the driven protrusion of the positioning hook pushes the driving protrusion of the driving element to abut against the second stop protrusion of the cover panel.

7. The position adjusting mechanism as claimed in claim 3, wherein the cover panel further has a first stop protrusion and a second stop protrusion, the first stop protrusion and the second stop protrusion separately formed on the inner surface of the cover panel;

the torsion spring is disposed between the positioning hook and the first stop protrusion;

the two ends of the torsion spring respectively and resiliently abut against the first stop protrusion and the positioning hook;

the driving protrusion of the driving element is disposed between the second stop protrusion and the driven protrusion of the positioning hook; and the driven protrusion of the positioning hook pushes the driving protrusion of the driving element to abut against the second stop protrusion of the cover panel.

8. The position adjusting mechanism as claimed in claim 4, wherein the cover panel further has a first stop protrusion and a second stop protrusion, the first stop protrusion and the second stop protrusion separately formed on the inner surface of the cover panel;

the torsion spring is disposed between the positioning hook and the first stop protrusion;

the two ends of the torsion spring respectively and resiliently abut against the first stop protrusion and the positioning hook;

the driving protrusion of the driving element is disposed between the second stop protrusion and the driven protrusion of the positioning hook; and the driven protrusion of the positioning hook pushes the driving protrusion of the driving element to abut against the second stop protrusion of the cover panel.

9. The position adjusting mechanism as claimed in claim 5, wherein the at least one sliding hole comprises two sliding holes; the cover panel further has two mounting protrusions formed on the inner surface of the cover panel;

the positioning hook is mounted around one of the mounting protrusions;

the torsion spring is mounted around the other mounting protrusion; and the at least one sliding rod comprises two sliding rods respectively mounted through the mounting protrusions, respectively mounted through the sliding holes of the mounting panel, and respectively connected with the washers.

10. The position adjusting mechanism as claimed in claim 6, wherein the at least one sliding hole comprises two sliding holes;

the cover panel further has two mounting protrusions formed on the inner surface of the cover panel;

the positioning hook is mounted around one of the mounting protrusions;

the torsion spring is mounted around the other mounting protrusion; and the at least one sliding rod comprises two sliding rods respectively mounted through the mounting protrusions, respectively mounted through the sliding holes of the mounting panel, and respectively connected with the washers.

11. The position adjusting mechanism as claimed in claim 7, wherein the at least one sliding hole comprises two sliding holes;

the cover panel further has two mounting protrusions formed on the inner surface of the cover panel;

the positioning hook is mounted around one of the mounting protrusions;

the torsion spring is mounted around the other mounting protrusion; and the at least one sliding rod comprises two sliding rods respectively mounted through the mounting protrusions, respectively mounted through the sliding holes of the mounting panel, and respectively connected with the washers.

12. The position adjusting mechanism as claimed in claim 8, wherein the at least one sliding hole comprises two sliding holes;

the cover panel further has two mounting protrusions formed on the inner surface of the cover panel;

the positioning hook is mounted around one of the mounting protrusions;

the torsion spring is mounted around the other mounting protrusion; and the at least one sliding rod comprises two sliding rods respectively mounted through the mounting protrusions, respectively mounted through the sliding holes of the mounting panel, and respectively connected with the washers.

13. The position adjusting mechanism as claimed in claim 5, wherein the at least one sliding hole comprises two sliding holes;

the cover panel has four mounting protrusions formed on the inner surface of the cover panel;

the positioning hook and the torsion spring are respectively mounted around two of the mounting protrusions;

the at least one sliding rod comprises two sliding rods respectively mounted through the other two of the mounting protrusions, respectively mounted through the two sliding holes of the mounting panel, and respectively connected with the washers;

two riveting elements are mounted through the two mounting protrusions that the positioning hook and the torsion spring are mounted around, and are riveted to the cover panel, and each of the riveting elements has a head abutting a distal end of a corresponding one of the mounting protrusions;

wherein a diameter of the head of each riveting element is larger than a diameter of the corresponding mounting protrusion; and the positioning hook and the torsion spring are held between the cover panel and the heads of the riveting elements.

14. The position adjusting mechanism as claimed in claim 6, wherein the at least one sliding hole comprises two sliding holes;

the cover panel has four mounting protrusions formed on the inner surface of the cover panel;

the positioning hook and the torsion spring are respectively mounted around two of the mounting protrusions;

the at least one sliding rod comprises two sliding rods respectively mounted through the other two of the mounting protrusions, respectively mounted through the two sliding holes of the mounting panel, and respectively connected with the washers;

two riveting elements are mounted through the two mounting protrusions that the positioning hook and the torsion spring are mounted around, and are riveted to the cover panel, and each of the riveting elements has a head abutting a distal end of a corresponding one of the mounting protrusions;

wherein a diameter of the head of each riveting element is larger than a diameter of the corresponding mounting protrusion; and the positioning hook and the torsion spring are held between the cover panel and the heads of the riveting elements.

15. The position adjusting mechanism as claimed in claim 7, wherein the at least one sliding hole comprises two sliding holes;

the cover panel has four mounting protrusions formed on the inner surface of the cover panel;

the positioning hook and the torsion spring are respectively mounted around two of the mounting protrusions;

the at least one sliding rod comprises two sliding rods respectively mounted through the other two of the mounting protrusions, respectively mounted through the two sliding holes of the mounting panel, and respectively connected with the washers;

two riveting elements are mounted through the two mounting protrusions that the positioning hook and the torsion spring are mounted around, and are riveted to the cover panel, and each of the riveting elements has a head abutting a distal end of a corresponding one of the mounting protrusions;

wherein a diameter of the head of each riveting element is larger than a diameter of the corresponding mounting protrusion; and the positioning hook and the torsion spring are held between the cover panel and the heads of the riveting elements.

16. The position adjusting mechanism as claimed in claim 8, wherein the at least one sliding hole comprises two sliding holes;

the cover panel has four mounting protrusions formed on the inner surface of the cover panel;

the positioning hook and the torsion spring are respectively mounted around two of the mounting protrusions;

the at least one sliding rod comprises two sliding rods respectively mounted through the other two of the mounting protrusions, respectively mounted through the two sliding holes of the mounting panel, and respectively connected with the washers;

two riveting elements are mounted through the two mounting protrusions that the positioning hook and the torsion spring are mounted around, and are riveted to the cover panel, and each of the riveting elements has a head abutting a distal end of a corresponding one of the mounting protrusions;

wherein a diameter of the head of each riveting element is larger than a diameter of the corresponding mounting protrusion; and the positioning hook and the torsion spring are held between the cover panel and the heads of the riveting elements.

17. The position adjusting mechanism as claimed in claim 5, wherein the driving element further has a boss formed on a bottom of the driving element and rotatably protruding in the through hole of the cover panel; and a driving recess formed in the boss.

18. The position adjusting mechanism as claimed in claim 8, wherein the driving element further has a boss formed on a bottom of the driving element and rotatably protruding in the through hole of the cover panel; and a driving recess formed in the boss.

19. The position adjusting mechanism as claimed in claim 5, wherein the at least one positioning rack and the mounting panel of the bracket are separate parts.

20. The position adjusting mechanism as claimed in claim 8, wherein the at least one positioning rack and the mounting panel of the bracket are separate parts.

* * * * *